United States Patent [19]

Leathem et al.

[11] 4,134,190

[45] Jan. 16, 1979

[54] CASKET LIFTING DEVICE

[75] Inventors: Bruce M. Leathem, Carthage; George E. Leathem, Bensenville, both of Ill.

[73] Assignee: Liftco Industries, Inc., Carthage, Ill.

[21] Appl. No.: 804,894

[22] Filed: Jun. 9, 1977

[51] Int. Cl.[2] ..... A61G 17/00

[52] U.S. Cl. ..... 27/27

[58] Field of Search ..... 27/27, 26, 1, 2

[56] References Cited

U.S. PATENT DOCUMENTS

| | | | |
|---|---|---|---|
| 974,679 | 11/1910 | Kremer | 27/27 |
| 1,925,964 | 9/1933 | Koppe | 27/27 X |
| 2,655,713 | 10/1953 | Chrisman | 27/27 |
| 2,817,138 | 12/1957 | Merz | 27/26 |

*Primary Examiner*—John D. Yasko

*Attorney, Agent, or Firm*—Thomas M. Scofield

[57] ABSTRACT

A casket lifting, supporting and transporting device operable by a single man; a wheeled frame having frame sections with lifting assemblies moveable under the ends of a casket mounted on a casket pedestal; elevating, supporting and lowering mechanisms operable by the single individual associated with the frame sections for receiving the casket thereon, elevating it, supporting it, storing it (if desired) and lowering it onto another support after transport to another location.

5 Claims, 8 Drawing Figures

CASKET LIFTING DEVICE

BACKGROUND OF THE INVENTION

In funeral homes and the funeral business, depending on the circumstances, caskets may be mounted on pedestals for display, show-room trucks, biers, church trucks or other like devices or supports. In the past various devices and means have been provided for lifting a casket from one support, holding it in the lifted position and either transporting the casket to another location and support or replacing the original support with another. The simplest such "device" involves a plurality of strong men simply lifting the casket and changing its location or support. Other devices of varying complexity and versatility have additionally been provided of greater or lesser usefulness. The industry and art needs a simple, rugged apparatus or device which can be entirely operated and manipulated by a single man which not only will engage, raise, maintain elevated and lower a casket, but also permit its movement and transport from one location to another, guided and handled by but a single individual.

THE PRIOR ART

Applicant is aware of the following Patents relating to vehicle jacks, portable lifters, hoisting trucks and wheel dollies and jacks:

U.S. Pat. No. 1,275,381 to Butler et al isssued Aug. 13, 1918 for "Vehicle Jack";

U.S. Pat. No. 1,622,201 to Little issued Mar. 22, 1927 for "Portable Lifter For Beehives";

U.S. Pat. No. 3,291,488 to Beebe "Hoisting Truck For A Table . . . " issued Dec. 13, 1966; and U.S. Pat. No. 3,836,027, to Gardner issued Sept. 17, 1974 for "Truck Wheel Dolly".

With respect to the known devices and means for handling elongate caksets and the like, Applicant has no Patent citations for the Patent Office. However, devices are known which straddle a casket along its longitudinal axis and have depending means for engaging, lifting and lowering the casket. Analogous devices are used to handle bodies with the bodies at right angles to the frame. Church trucks are known for moving caskets. Casket jacks, one applied under each end of a casket are additionally employed to raise and lower a casket with respect to a show room truck, bier or Church truck.

BRIEF DESCRIPTION OF THE INVENTION

The instant device comprises an elongate frame which is C or U-shaped in plan view. The frame has an elongate base beam to which is rigidly connected two shorter frames. The frame assembly is mounted on four casters or dolly wheels which give versatility of translation of the frame about and on a floor surface. Mounted atop the side frames are a pair of jointly and simultaneously elevatable support beams which operate to engage the underside of the casket and lift it from a casket pedestal, bier, church truck, show room truck or the like. Once maximally elevated, the support beams are retained in elevated position until returned to a lower position by the operator.

OBJECTS OF THE INVENTION

A first object of the invention is to provide a novel and improved casket handling device.

Another object of the invention is to provide an improved casket handling device which may be operated in all of its functions by but a single individual.

Another object of the invention is to provide a casket receiving frame, such having elevating, elevated support and lowering means associated therewith of novel character, great strength, simplicity and ease of use and operation.

Another object of the invention is to provide a casket handling device of maximum utility in all phases of casket handling, some entirely operable by but a single individual, the device safe and dependable in operation yet relatively cheap and easy to manufacture.

Another object of the invention is to provide such an improved casket handling device wherein all of the parts thereof are readily and continuously available for inspection, repair or replacement.

Still another object is to provide an improved device which will endure a long life of hard and continuous use without significant wear because of the simplicity and strength of its parts.

Other and further objects of the invention will appear in the course of the following description thereof.

DESCRIPTION OF THE DRAWINGS

In the drawings, which form a part of the instant specification and are to be read in conjunction therewith, an embodiment of the invention is shown and, in the various views, like numerals are employed to indicate like parts.

STRUCTURE AND FUNCTION

Figure 4:
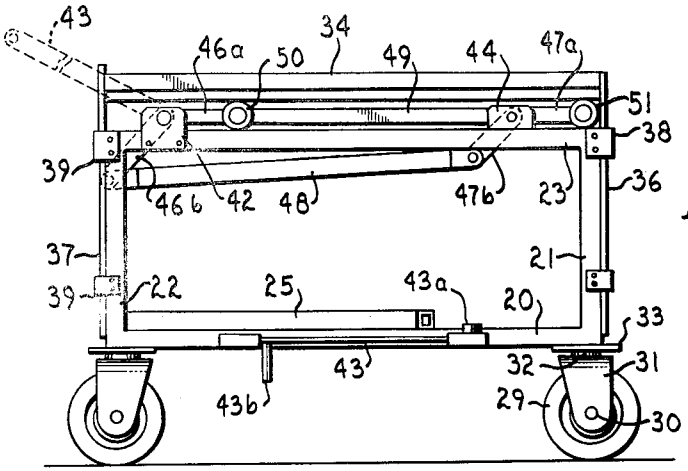
FIG. 4 is a side view of the device of the previous figures (taken from the right hand side of FIG. 1 looking to the left in the view of FIG. 1) with the device in the lowered position.
Figure 5:
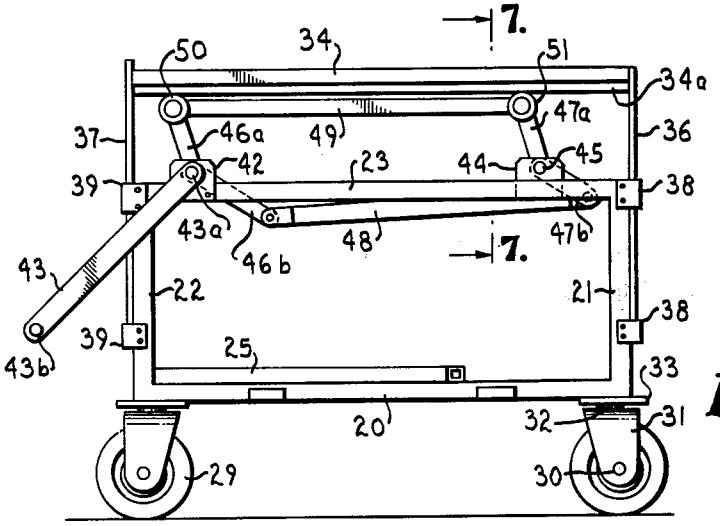
FIG. 5 is a view like that of FIG. 4, but with the device in the elevated position in the view.

Referring first to FIGS. 4 and 5, therein is illustrated one of two side frame members included in the frame assembly embodying the invention. In these views, there is a rectangular frame, preferably of box beam construction, having bottom beam 20, normally horizontal, front and rear beams 21 and 22 connected at their lower ends to beam 20 at the ends thereof and extending upwardly normal thereto and top beam 23. As may be seen from the other Figures, this frame, comprised of end connected box beam members 20–23, inclusive, is held structurally erect.

Figure 1:
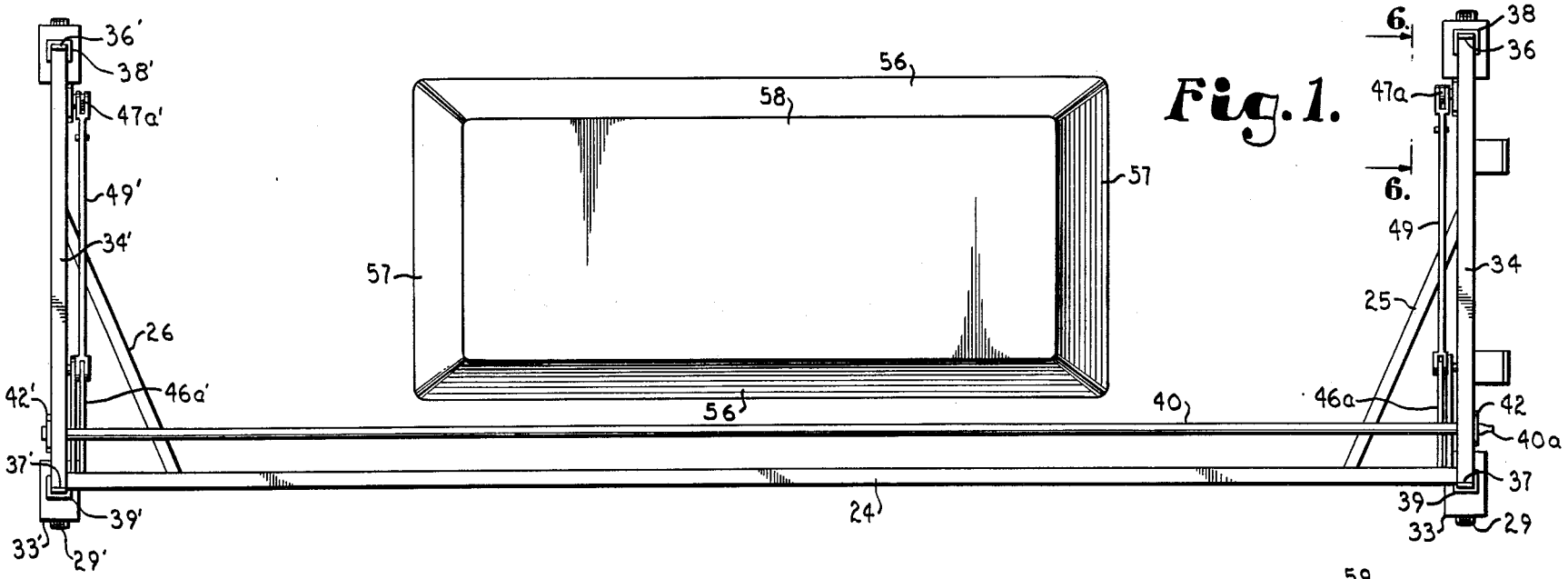
FIG. 1 is a top plan view of the subject improved casket lifting device or truck positioned operatively with respect to a casket pedestal (but without having the casket mounted on the pedestal, in order to better show the structure of the device in plan view).
Figure 3:
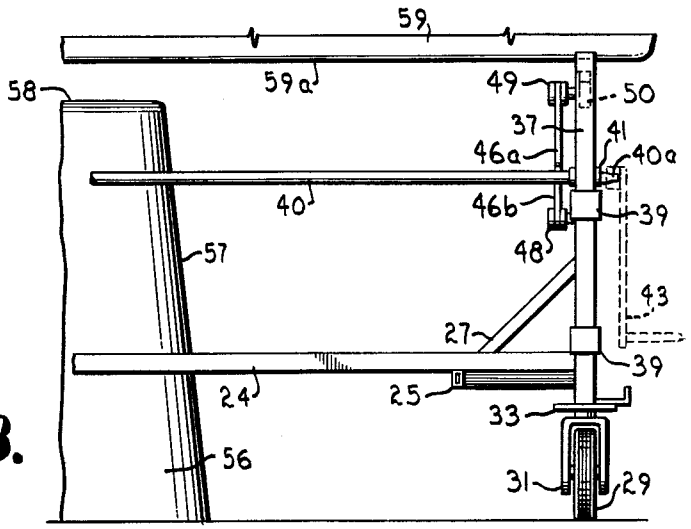
FIG. 3 is a view from the front of the right hand side of the device of FIG. 1 (looking upwardly in the view of FIG. 1 at the right hand side of the device), but with the casket lift truck elevated in FIG. 3, raising the casket from the pedestal.
Figure 2:
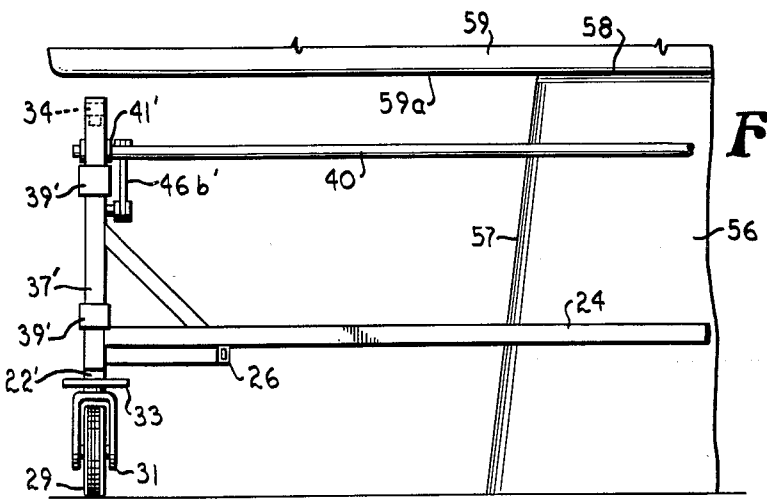
FIG. 2 is a front view of the left side of the frame of FIG. 1 (looking upwardly in the view of FIG. 1 on the left side thereof) showing the subject device positioned under a casket which is mounted on the pedestal, the casket lifting device in lowered position.
Figure 7:
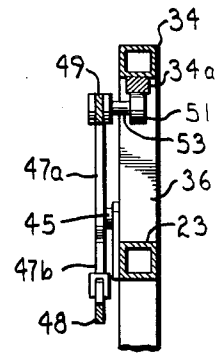
FIG. 7 is a view taken along the line 7—7 of FIG. 5 in the direction of the arrows.

A like, identical frame construction is provided in the frame assembly opposite the described frame, seen to the left in FIG. 1 and also to the left in FIG. 2, partially. Accordingly, identical frame and structural members to those corresponding with the frame member in the right hand side of FIG. 1 and the right hand side of FIG. 3 are numbered the same but primed, insofar as they appear in the Figures.

An elongate box beam 24 is welded or otherwise fixedly attached at its ends to the inboard faces of opposed frame members 22 and 22'. Auxiliary structural braces 25 and 26, also preferably of box beam construction, are rigidly connected at their front ends to the underside of beam 24 and at their forward ends to the upper sides of frame members 20 and 20'. Additional bracing members 27 and 28 are connected at their lower ends to the upper side of beam 24 and at their upper ends to the inboard faces of vertical frame members 22 and 22'.

At each of the four corners of the frame structure described, specifically, at the forward and rearward ends of frame members 20 and 20', there are provided dolly wheel assemblies, comprising each a wheel 29 mounted on an axle 30 carried in frame 31, whose base 32 is pivotably secured to plate 33 in conventional manner.

Each of the vertical rectangular frames at the sides of the device are provided with a lift assembly comprising basically normally horizontal beams 34 and 34' (which may have runner surfaces **34*a* (or 34*a'*) secured to the underside thereof) and guide means for the said beams 34 and 34'. The latter preferably comprise elongate rigid straps 36 and 37 (36' and 37' associated with beam 34'), members or straps 36 and 37 received in sleeves 38 and 39 fixed to the front and rear faces of vertical frame members 21 and 22, respectively. On the other side of the frame, vertical guide members or straps 36' and 37' are received in and guided by sleeves 38' and 39' mounted on the front and rear faces, respectively, of vertical beams 21' and 22'**.

Means are provided for simultaneously raising, holding aloft and lowering the beam supports 34 and 34'. Again, these means are duplicated on each vertical rectangular frame at the sides of the device in question. Accordingly, the said means on the frame of FIGS. 4 and 5 will be described, as well as the means coupling the two raising and lowering means, with the like parts on the opposite frame (where seen in the views) numbered the same, but primed.

An elongate cylindrical rod 40 is journaled in bearings 41 and 41' carried by plates 42 and 42' which are rigidly connected or fixed to the outboard faces of top frame members 23 and 23'. The right hand end (in the views of FIGS. 1 and 3) **40*a* of cylindrical rod 40 is made square or hexagonal in order to removably receive thereon the engaging end 43*a* of crank 43 having handle 43*b*** on the other end thereof.

Spaced forwardly on frame members 23 and 23' and fixed to the inboard faces thereof are plates 44 and 44' which carry thereon stub shafts 45 and 45'.

Rigidly fixed to elongate rod 40 inboard of frame members 23 and 23' are paired V-shaped members having upper legs **46*a* (46*a'*) and lower legs 46*b* (46*b'*). Rotation of cylindrical rod 40 by means of crank 43, clockwise or counter-clockwise in the views of FIGS. 4 and 5, thus carries V member 46 therewith in arcuate motion around the axis of shaft 40 (as well as opposed V member 46'**).

Figure 8:
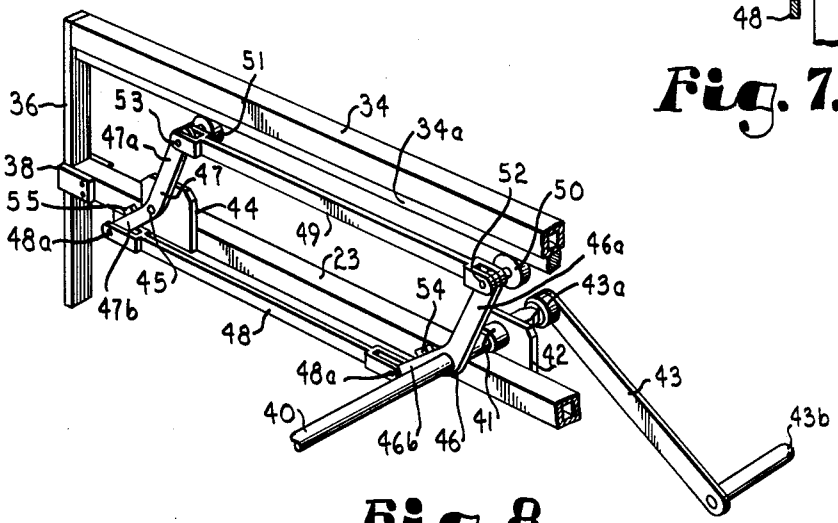
FIG. 8 is a three quarter perspective view from above of the lifting mechanism of the device (the device being in elevated position), the view taken from the inside of the frame of FIG. 1 looking downwardly and to the right in view of FIG. 1. This view is also fragmentary.

Mounted on stub shafts 45 and 45' are second V members 47 and 47'. Member 47 (47') has upper arm **47*a* (47*a'*) and lower arm 47*b* (47*b'*). Such are free to pivotably rock or arcuately move on stub shafts 45 and 45'. A first elongate rod or shaft 48 (48') having bifurcated ends thereon pivotably engages, by pins 48*a*, lower arms 46*b* and 47*b* of V members 46 and 47. Upper arms 46*a* and 47*a* are both likewise engaged by an elongate shaft or beam 49 having bifurcated ends as seen in FIG. 8, same pinned to the ends of arms 46*a* and 47*a*. Individual rollers or wheels 50 and 51 are rotatably mounted upon pins or shafts 52 and 53 which couple the bifurcated ends of beam 49 with the free ends of V arms 46*a* and 47*a***. Unprimed structure described is duplicated primed on the opposite frame.

Accordingly, what is provided, in the means above described, including cylindrical shaft 40, crank 43, V-arms 46 and 47, connecting beams or arms 48 and 49 and rollers 50 and 51, are a lever system which enables the lifting assembly of beams 34 and 34', together with guide members 36 and 37 (36' and 37') to be alternatively raised and lowered from the down position of FIG. 4 (crank up as seen in the view) to the fully raised position of FIG. 5 (crank down in the view). This lever system in effect cams up and down the lifting assembly under load.

Figure 6:
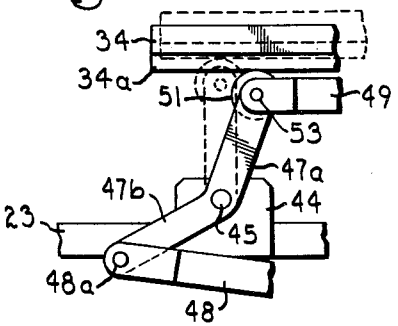
FIG. 6 is a view taken along the line 6—6 of FIG. 1 in direction of the arrows (showing the device elevated and going over top dead center).

In order to limit over-center movement of arms **46*a* and 47*a* in FIG. 8 (and the corresponding coupled arms 46*a'* and 47*a'* on the opposite frame), stops 54 (for arm 46*b*) and 55 (for arm 47*b*) are rigidly connected to and fixed to the inboard surface of frame member 23 for engagement by the said arms 46*b* and 47*b* when upper arms 46*a* and 47*a* go past top dead center from 12 to 15 degrees. This provides a stable, top lock position, which yet may be released by reverse action of the crank arm 43. Like stop structure is provided on the opposed top frame member 23'. The upper members 46*a* and 47*a* (46*a'* and 47*a'*) rotate approximately 15 degrees past top dead center to reach the rest-support position of FIGS. 5, 6 and 8**.

Brackets 56 are provided on frame member 20 to receive crank 43 when not in use. The top surfaces of beams 34 and 34' may be covered or cushioned as desired to protect the caskets being lifted and assure secure purchase.

USE AND OPERATION

Referring to FIGS. 1–3, inclusive, therein is shown a casket pedestal of conventional configuration having elongate side walls 56, end walls 57 and horizontal, flat top 58. The latter is adapted to receive the flat underside of a casket 59 as seen in FIG. 2. In operation of the device, as may be seen in FIGS. 1–3, inclusive, first the side frames are pushed under the ends of the casket, with the lifting assemblies in the down position of FIG. 4. Once the device is symmetrically located, as seen particularly in FIG. 1, as well as in FIG. 2, the operator then engages the crank end **43*a* with end 40*a* of cylindrical cranking rod 40, with the crank in the upper position as in FIG. 4. This engagement made, the operator then moves crank 43 counter-clockwise in the view of FIG. 4 toward the crank position of FIG. 5. An initial raise of a certain distance occurs before the top sides of lift beams 34 and 34' contact the underside 59***a* of casket 59.

Continuing to bear downwardly on the crank arm 43, the operator drives, through the lever linkages described, V member upper arms 46*a* and 47*a* to vertical and then slightly over-vertical position until V arms 46*b* and 47*b* encounter stops 54 and 55. Having gone past top dead center, the load then is carried into the stops 54 and thus into the frames.

With the load thus secured and locked against falling, the device may then be moved away from the casket pedestal from which the casket was lifted. The device may be moved to another pedestal, to a lift truck or any other conventional device or support for the purposes desired by the operator. Once to the new location, the casket may be lowered from the upper position of FIGS. 5 and 8 to the down position of FIGS. 2 and 4 by moving crank 43 in a clockwise direction from the position of FIGS. 5 and 8. Alternatively, the load or casket may be left on the subject lifting device until another place is selected for it, with the lifting device acting as a storage device. In such case the operator may or may not desire to lower the lifting apparatus from the upper position of FIGS. 5 and 8. If any extended interval of time is to pass, such will probably be done, for safety's sake.

MISCELLANEOUS DETAILS

While two stops 54 and 55 are shown in the views, particularly FIG. 8, to limit the travel of the members 46 and 47 in their arcuate rotation driven by handle 43, it should be understood that other arrangements are possible. A single stop may be provided on the underside of beam 23 to engage linkage 48 or vice versa. Additionally, it is feasible to design the linkage of rod 48 and lower arm 47 (48*b*) so that same comes into a binding condition at the extent of its travel, forming a natural stop.

Optimally, a 2½ inch lift is sufficient and feasible for one man operation in the device as shown. The requirement is to lift a 600 pound load with a handle 18 inches long, which requires an initial force of approximately 85 pounds (not considering the friction element). Up to a five or six inch lift could be designed into the device by making a configured handle (in order to miss the casket) and extend the length of the handle. In such case, the length of the guide bars and their engaging sleeves 38 and 39 would have to be adjusted to keep engagement of straps 36 and 37 by the latter. The handle passes through an arc of approximately 105 degrees in operation.

This device can be compounded with nesting guide frames and lifting mechanisms, but this increases the cost.

Casket for male and female bodies are of the same size, although of different decor. Casket width at the bottom is typically 28 inches, with a length of 80 inches or greater. The depth of the instant device with respect to members 34 and 34' is preferably approximately 26 inches, which is actually less than the width of the casket. It is adequate so that it extends well past the center of gravity of a loaded casket, thereby making it safe to move the casket from one location to another and enables the device to pass through any doorway that the casket itself alone will go through. Bier or pedestal structure typically involves a base of 66 inches in length with a top of less length. This enables the pickup actions seen in FIGS. 1-3, inclusive. With infant caskets, the subject device is not required.

Variants in length of the casket bier or pedestal and the device is optional. The length of the device must be less than the standard length of male and female caskets for engagement by members 34 and 34' of the underside of the casket. One guide strap 37 (37') may be somewhat extended upwardly to stop against the casket and in order to parallel the truck to the casket length. Caskets typically have a flat base. If a maximum height in the lowered position of FIG. 4 is provided around 20¾ inches, the device can be rolled under a casket which is positioned on a standard church truck and on standard height biers or pedestals.

The elongate rod 40 also provides some sway stability to the device. The handle can be connected on either end or, alternatively, if two man operation is employed, a handle can be connected to both ends. This lessens the effort required.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

We claim:

1. Lift means for casket handling comprising, in combination:

two rectangular frames positioned erect, each with two substantially vertical front and rear end beams and substantially horizontal top and bottom beams, the said beams rigidly connected to one another at the ends thereof, the said frames laterally spaced apart from and oriented parallel to one another, an elongate, rigid cross beam connecting the front beams of the frames intermediate the upper and lower ends thereof, whereby to provide a rigid C-shaped frame assembly in plan view thereof, four pivotable dolly wheels attached to the undersides of the rectangular frames, one at each lower corner thereof, a normally horizontal support beam positioned above each top rectangular frame horizontal beam in substantially parallel orientation thereto, paired, spaced apart guide sleeves on the front and rear frame beams, a guide member fixed to each end of each of the horizontal support beams and extending downwardly substantially normal thereto, said guide members slideably received in said guide sleeves on the front and rear frame beams, and means on said rectangular frames and cooperating there between for sequentially but simultaneously raising and lowering said horizontal support beams with respect to said rectangular frames.

2. Lift means as in claim 1 including bracing means cooperating between the cross beam and rectangular frames for greater structural strength and rigidity.

3. Lift means as in claim 1 wherein the means for raising and lowering the horizontal support beams simultaneously, one with the other, comprises a pair of arms pivoted at their lower ends to the top horizontal frame beams, coupled together at their upper ends and having rollers rotatably mounted on their upper ends underlying the said horizontal support beam, and p1 means for simultaneously together elevating the said sets of arms around their pivots to a stable over-top dead center vertical position and thereafter lowering them, whereby to sequentially elevate, hold elevated and lower the said horizontal support beams together and sequentially.

4. Lift means as in claim 3 wherein the said latter means comprises an elongate cranking rod rigidly connecting to two opposed ones of the said pivoted arms at their pivots, linkage means coupling said pivoted arms past their pivot point and stop means on said frame limiting the arcuate pivot of said pivoted arms shortly past top dead center past vertical orientation of the said arms.

5. Lift means as in claim 1 wherein the rectangular frame members are box beams in transverse section and the guide members are flat strips.

* * * * *